US005453024A

United States Patent [19]

Patinier

[11] Patent Number: 5,453,024

[45] Date of Patent: Sep. 26, 1995

[54] TWO-PIN ELECTRIC PLUG, TO BE WIRED WITHOUT UNSHEATHING THE LEAD

[76] Inventor: André Patinier, 21 rue de Cronstadt, Paris, France, 75015

[21] Appl. No.: 232,128

[22] PCT Filed: Nov. 5, 1991

[86] PCT No.: PCT/FR91/00862

§ 371 Date: Apr. 28, 1994

§ 102(e) Date: Apr. 28, 1994

[87] PCT Pub. No.: WO93/09579

PCT Pub. Date: May 13, 1993

[30] Foreign Application Priority Data

Nov. 2, 1990 [FR] France ..... 90 13624

[51] Int. Cl.[6] ..... H01R 4/24

[52] U.S. Cl. ..... 439/410

[58] Field of Search ..... 439/409, 410, 439/419

[56] References Cited

U.S. PATENT DOCUMENTS

| | | | |
|---|---|---|---|
| 2,658,184 | 11/1953 | Greenbaum | 439/410 |
| 2,717,365 | 9/1955 | Greenbaum | 439/410 |
| 3,596,232 | 7/1971 | Medley | 439/410 |
| 3,745,228 | 7/1973 | Vogt | 439/409 X |
| 4,129,350 | 12/1978 | Winn | 439/410 |
| 4,842,546 | 6/1989 | Song | 439/409 |

*Primary Examiner*—Z. R. Bilinsky

[57] ABSTRACT

An unearthed two-pin electric plug is provided. To avoid the need for tools when wiring, the plug includes a blade (2,22,62) rotating about the axis of a hinge (1) which is parallel or perpendicular to the axis of the electric lead. In the two fullest embodiment of the plug, projections cooperate to split, set up connections and connect up the lead. In one embodiment, the inner surface of the lower plug portion includes a base (80) with grooves (71,72,73) engaged by tapered splitting portions (51,52,53) which push the two conductors of the leads sideways so that they slide over the base (80) and are caught on contact spikes (5) at almost the same time as said lead is cut by the central blade (62). The lead is held in position by a filler bar (50) and by the splitting portions (51,53) which drive the lead sideways so that it winds through recesses (81,83).

5 Claims, 12 Drawing Sheets

TWO-PIN ELECTRIC PLUG, TO BE WIRED WITHOUT UNSHEATHING THE LEAD

The invention relates to two-pin electric plugs, to be used with a flexible two-wire cable.

The aim of this invention is to dispense with the need of any tools, such as knives, screwdrivers or pliers, necessary to fasten the cable to the plug, as well as to facilitate this operation to a greater extent than in the prior related inventions.

Prior inventions have not succeeded in dispensing with the need of any tool for the wiring.

It is the case of the Switz Patent 383 458, and the U.S. Pat. Nos. 2,658,184 and 4,842,542, called D1, D2 and D3, respectively, hereafter.

In D1, a built-in screw, has to be screwed in, either with screwdriver, or with a coin used as one.

In D1, D2 and D3, the device calls for the use of plier to even out the ends of the electric cable, if needs be.

In D2 and D3, there is no splitting device for the cable wires, therefore a cutting tool is required, as current two-wire cables are coated with an outer sheath.

In D1 the separation process of the two cable wires, which uses a cone-shaped screw, calls for strength when both wires are coated by the outer sheath. This cone-shaped screw system does not allow either the wires to follow a sinuous enough path, that would lock them into place in the event of strain applied on the plug (see D1, FIGS. 2 and 5). Furthermore, the curved path resulting from the separation of the wires is the actual connection spot. Therefore, any strain applied on the cable, is also directly applied on the connection devices and there is a real possibility of damaging them. This becomes even more apparent if we consider that most wires—those used in our invention too—exhibit sharp and fragile metallic prongs at their ends. In D2, the ridge system (33) used to lock the cable (FIGS. 1,4,5) does not seem to be very efficient.

The present invention solves these problems.

In the three embodiments of the invention discussed here, the cutting and the wiring of the electric cable are performed simultaneously with the shutting of the plug.

Furthermore, in the second embodiment of the invention, the cable is set into position automatically. Finally, in the third and fullest embodiment, the shutting of the plug causes the wiring and, at the same time, twists and turns in the path of the cable, such that, even a strong stress applied on the cable, has no effect on the part of the wires used in the connection. Also, no strain is brought on the plug contact parts.

The three embodiments of the invention share the following:

At least three contact spikes are used, with a 5 mm spacing lengthwise, and laterally so that the inner conducting part of each wire may be reached to at least a third of its depth on both sides, and to the center of its section in the middle. The spikes should be oriented toward the conducting heart of the wire, according to the direction it follows as it gets cut, and should be long enough to cut through the conducting part of the said wire. The said contact spikes are at least three tenths of a millimeter thick, or for example, a third of the diameter of the conducting portion of the cord; these spikes being a built-in feature of the female or male pins of the plug. The points and edges of these elements are sharp or should be sharpened.

Their use dispenses with the need of stripping the insulating sheath from the ends of the cord and screwing in the unsheathed wires.

A T-shaped blade is incorporated to the plug, and securely hooked in the plastic block, in which is is partially embedded. The dimensions of this blade are such that, in the fullest embodiment of the invention, the cable is fully cut to its end situated in the plug, prior to its wires being led through their recesses.

This feature dispenses with the need a knife to unsheathe the electrical cord, and split the two wires.

The cutting device, built into the plug, calls for the presence of a blade rotating around an axis, this axis being either parallel, or, on the contrary, perpendicular, to the longitudinal axis of the cable.

In the first embodiment of this invention, the rotation axis is parallel to the axis of the cable, and in the other two, the rotation axis is perpendicular to the axis of the cable.

In the first embodiment of the invention, the male and the female pins are cut lengthwise, along the plane containing the diameter of each of the two male pins or, of each of the two female pins, according to the kind of plug. This plane will be called "longitudinal median plane of the pins" or "longitudinal median plane", throughout this patent. In the case of the male pins, the inner part of the pins located into the plastic block is shaped to act as a contact site for the wires. The inner diameter of these half-cylindrical parts is slightly longer than the outer diameter of a wire from the largest cable fitting the plug.

In the case of a female pin, the inner diameter of the inner part is equal to the outer diameter of the male pin. The contact site is then formed by a half-cylinder of the same shape and size as those of the male pin. In both cases, the lower half of the contact site is equipped with a heightening, that decreases by a quarter the total height of the contact site, in order to squeeze the cable wire and hold it into place. Both the top and the receiving portions of the (male or female) plug also include a contact device in-between, in the form of other (male and female) pins in the plug itself. This contact device has a vase-shaped transverse profile, larger at the top than at the bottom, round at the top, and split into two halves. This mechanism acts as a pressure locking device for the whole plug. The contact spikes stand on the bottom of the receiving (lower) half of the contact site.

In the case of the embodiment where the hinge is perpendicular to the axis of the cable, the male and the female pins include contact spikes on their outer surface. The spikes and the pins then form one single block (just as in the previous example). In order for the connection to be a one-step operation in the first example, it is necessary that the cable be fully cut, before both its wires are driven by a block called "pressing block", sliding along a 40° sliding plane. Both sliding planes form a splitting projection, whose profile is complementary to that of the pressing block. The cord is then led to the contact site, at the bottom of which the contact spikes stand, oriented in the same direction as the sliding planes and the axis going through the center of the (male and female) pins and the wires, once they are at the bottom of the contact site. The pressing block contains edges that scrape the sliding planes, and form the inner edge of the higher surface of the leading grooves and the contact site. The total height of the cavity formed by the contact site and the higher leading groove is smaller by a quarter of a radius than the diameter of the largest cable wires fitting the plug.

In order for the cutting to follow the complete path of the wires, it is necessary that the knife blade have the following characteristics:

the angle of its front end ($\delta$) is ($90°-\alpha$)

the height (h) at the front end is at least equal to $h=l_1\times tg(\alpha)+D/\sin(\delta)+AD+E/2$, where $l_1$ the length of the wire lying in the contact site, α the angle at which the wire goes down, D the diameter of the largest cable wire fitting the plug, AD the plunging distance of the wire, and E the thickness of the higher portion.

the length of the cutting edge is at least equal to $l_1$+ the length of the portion of wire that goes down, and whose value is described elsewhere.

According to the second, and most recent, example with perpendicular axes, the wiring is also performed in a one-step operation and can take place during the cutting of the cable. The inner surface of the active plug portion contains, as previously, projections cooperating with those of the inner surface of the passive portion, to split, set into place, and connect the cable to the plug.

The inner surface of the active portion contains a filler bar (50),i.e. a holding device keeping the wires separated by the blade (62) and split by the three splitting portions (51,52,53), that enter their respective recesses (71,72,73), located on the inner surface of the passive plug portion. The passive portion contains a sliding surface parallel to the longitudinal median plane of the pins, called the base (80), for the cable wires. The sliding occurs while the splitting devices come into their grooves, splitting and connecting the wires. The action of the conical splitting portions (51,52,53) that start the connection further achieved by piercing the insulator, is facilitated, and completed by the filler bar (50), which ensures a maximum penetration of the contact needles (4) or spikes (5) into the conducting heart of a cable wire. The filler bar (50), combined with the splitting portions, also ensures that the cable wires are tight and fixed, as long as the plug remains shut. The front (51) and back (53) splitting portions have a maximum width greater than that of the filler gap (50), while the walls (85) of the case include recesses, through which the wire can wind. This device holds the cord in position, and avoids any displacement during accidental strain on the cable, or during use, as well as any damage to the contact spikes (5) or accidental disconnection of the system.

The advantages and features of the invention are illustrated in the accompanying drawings.

Figure 16A:
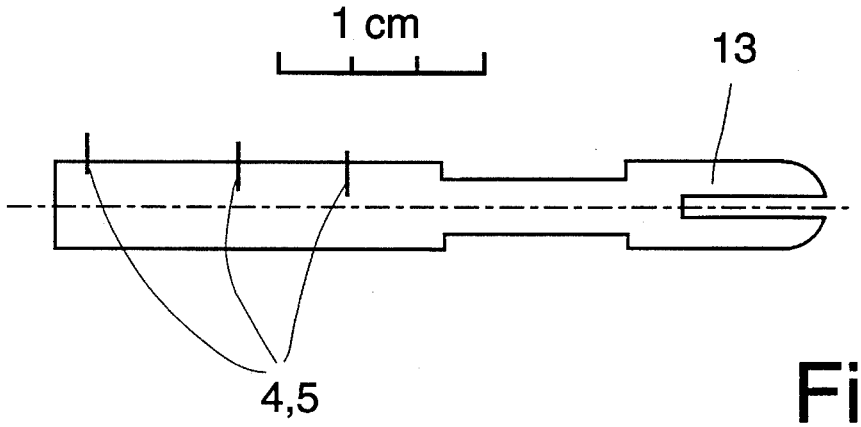

FIG. 16*a* is a side view of a male pin of the plug, according to the embodiment with the perpendicular axes.

Figure 16B:
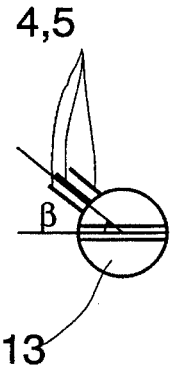

FIG. 16*b* is a front view of a male pin of the plug, according to the embodiment with the perpendicular axes.

Figure 17:
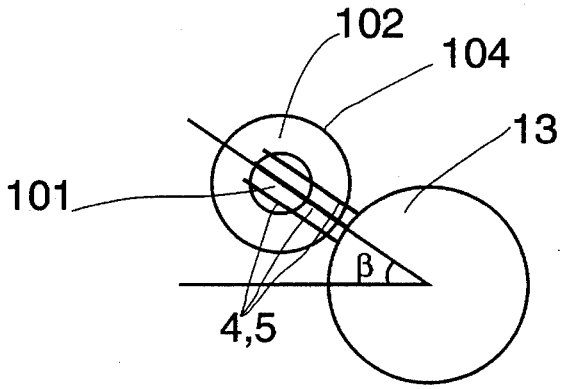

FIG. 17 is the scheme of a front view of a pin/cord couple, showing the orientation of the contact spikes, according to the first embodiment, with perpendicular axes.

Figure 18:
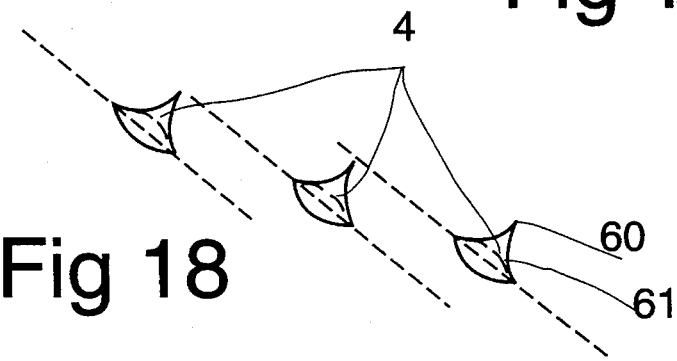

FIG. 18 shows the shape and arrangement of the contact spikes.

None of these figures is drawn to scale, but FIGS. 3,5,7,9,11,13,14 can serve as references. However, some details are approximated, and the precision of the drawings is not perfect. Although the proportions are indications, they constitute nevertheless a rather precise picture of the reality. For clarity in the drawings, a lot of angles have been drawn as sharp. It is only necessary for the the wedging edge and both edges of the scraper, as well as for the hollow projections of the lower portion in the three embodiments. All other angles may be rounded.

DETAILED PRESENTATION OF THREE EMBODIMENTS OF THE INVENTION

The most conventional embodiment includes a two-part plug: an outer case, in which the pin-containing block is embedded. In this version of the embodiment, the axes of the hinge and of the electrical cord are parallel. The following description relates only to the block.

Figure 1:
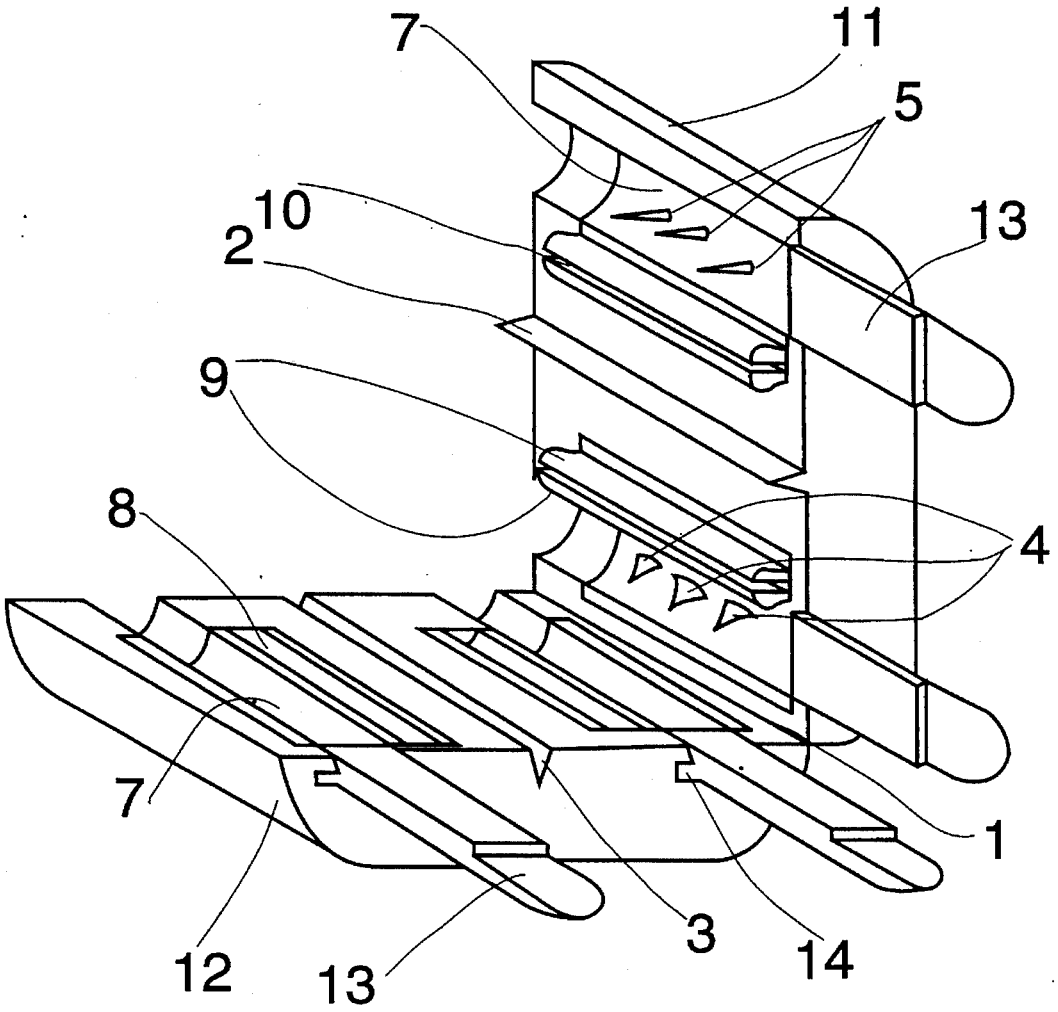
FIG. 1 is a perspective view of the inside of a male plug in the example where the rotation axis of the hinge is parallel to the axis of the cable.
Figure 2:
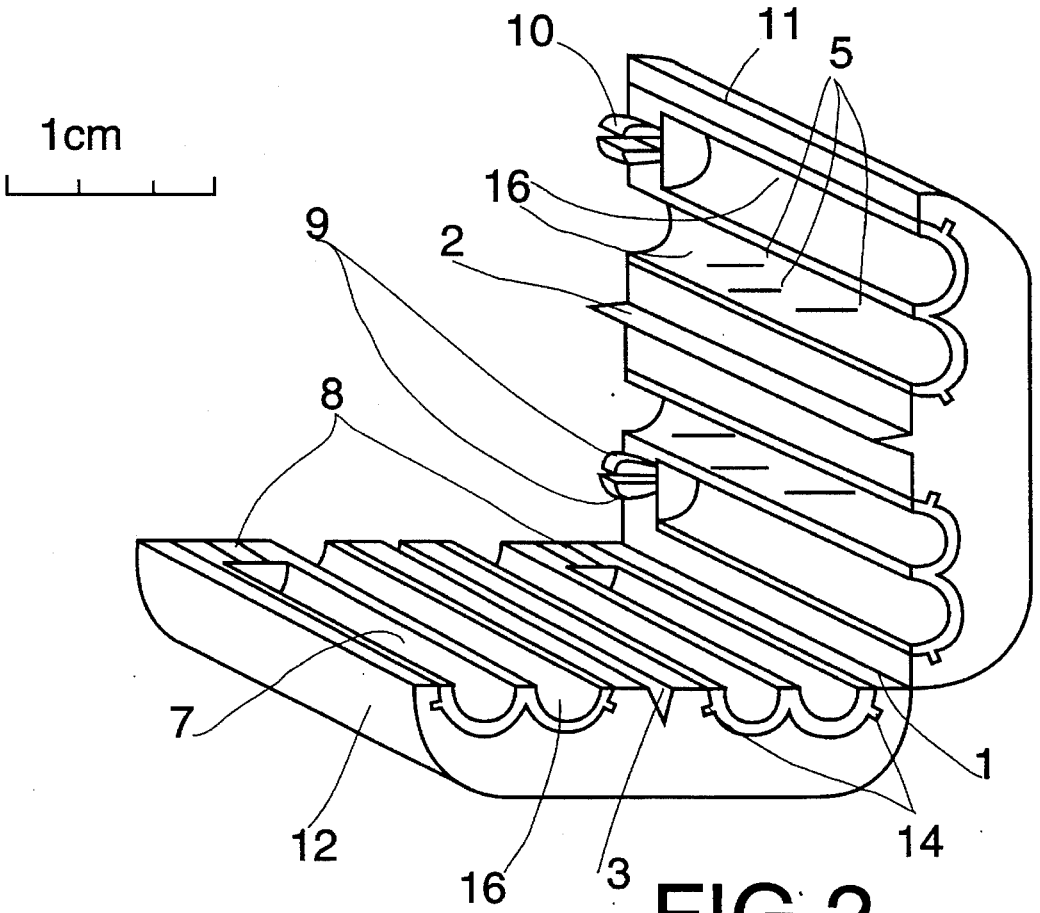
FIG. 2 is a similar view, for a female plug.
Figure 3:
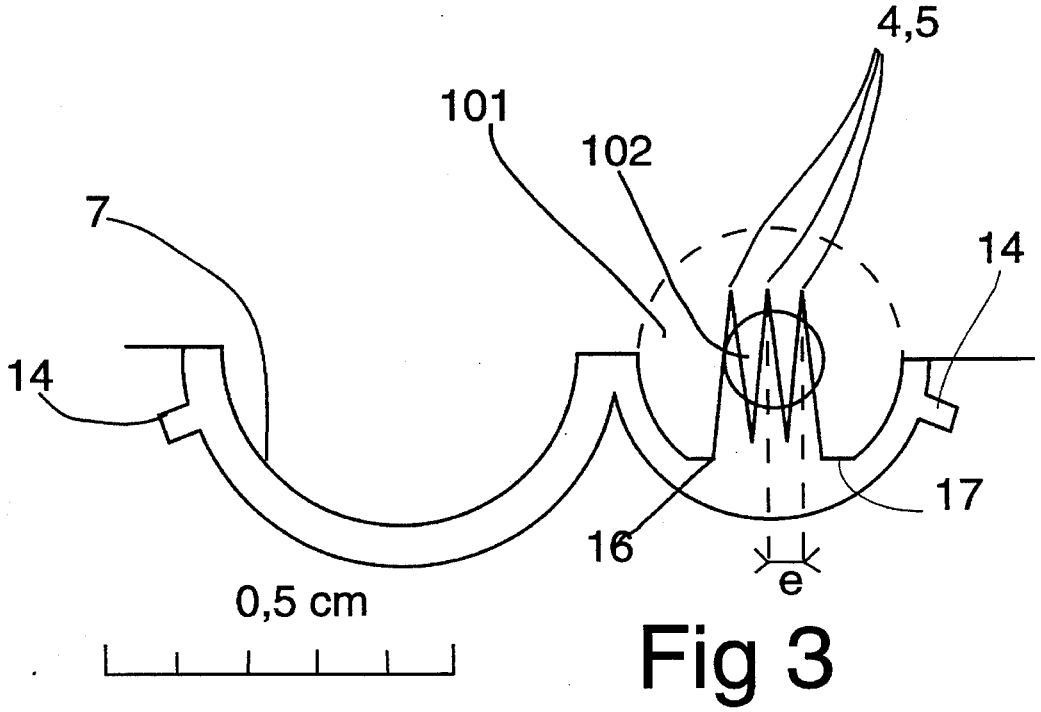
FIG. 3 is a view down the longitudinal axis of a female pin, showing the arrangement of the contact spikes on the lower portion of the block.

FIGS. 1, 2 and 3 will be discussed here. FIG. 1 shows an example of a male plug, in which the block is split into two halves, an active (11) and a passive (12) one, jointed around a hinge (1). In the center of the active portion (11), there is the blade (2), used to cut the cable lengthwise and set the two wires apart, after having evened out the ends, with the same blade (2). This can be performed by closing down the active portion (11) onto the passive portion (12), on the cable, placed perpendicularly to the longitudinal axis of the knife cavity (3). The pins (13) are divided into two halves, full outside the block (11 or 12), whereas their portion inside the block (7) is hollow. The pins (13+7) form one piece, with a contact cavity (8) in the lower part of the block (12), and contact pins (9) in the higher portion (11). The pins (9) and the cavity (8) are complementary in shapes, the pins (9) being the male pins of a "plug inside the plug", so that the same current goes through the two outer halves of the pins (13). The transverse profile of the pins (9) shows a relative narrowing at the bottom and a widening near the top, curving around toward the central slot (10). Because of this profile, parts (8) and (9) are locking the entire block in a closed position. The system works as follows:

The cable is laid down in the knife cavity (3), and centered so that the blade is placed over the portion of the cord to be cut, and between the two wires, and then cut lengthwise by closing the system and applying pressure. The active half

(11) of the plug is then lifted and each wire is placed into each inner part of the pins (13). One needs only to slowly but firmly close the active part (11) down onto the passive part (12) of the plug.

FIGS. 1 and 2 show the contact needles (5) or spikes (4) drawn on the active portion (11) of the block, but they can also be placed on the passive portion (12). In that case, the user will have to set the wires apart and place them on the contact spikes or needles—by hand—so that they penetrate the insulating part of the cable. Closing the system will have the spikes cut through and reach the heart of the cable. We have drawn two kinds of contact shapes. Both shapes can be used but it would not be sensible to place needles in one cavity and spikes in another.

FIG. 3 shows a blown-up transverse view of the metallic piece used as the integrated part of the female pin (7) and the half-cylinder (16). It also shows the arrangement of the contact needles or spikes (4 or 5), and their length that should be slightly longer than the thickness of the insulating sheath (101) plus the diameter of the conducting heart (102), for the thickest cable that can fit the plug. The contact spikes are arranged in a staggered fashion, spaced by a distance equal to their own thickness "e", that is a third of the diameter of the conducting heart (102), with a minimum of three tenths of a millimeter, and arranged in such a way that one of them is situated on the longitudinal vertical and central plane of the wire, and the others distributed on the right and the left sides of the cable. It is worth mentioning the flat piece (17) used to prevent the cable from getting loose in the half-cylinder (16), also called contact site.

FIG. 2 shows a female plug, where the arrangement of the elements is different, because the integrated portion (7) of the pins (13) makes up the entire plug itself and is occupied by the male pin ready to be connected. The contact site (8) and the inner pin (9) are pushed back behind the female pins, thus lengthening the block formed by parts (11) and (12). The half-cylinders (16) will accommodate the wires in the same way the inner parts (7) of the male pins (13) do for the male plugs. Small fixing lugs (14) are also necessary in the plastic block.

The outer surfaces of parts (11) and (12) are carved in such a way that, as in the existing devices, the closed system can be fitted in a case.

According to the first version of the invention, four other operations are needed to perform the connection, after the ends of the cable have been evened out:

1) longitudinal cutting of the cable 2) setting up of the cable wires in their grooves 3) closing of the block onto itself 4) fitting of the block into a case These four steps are combined into one single operation in the second embodiment of the invention.

The parting of the cable wires is also performed with a blade, but right after the cutting, by pushing down a pressing block. They are automatically set into place with the pressing block scraper, the leading grooves and the sliding planes. There is no need to fit the block into a case, since the system forms a whole block in itself.

Figure 4:
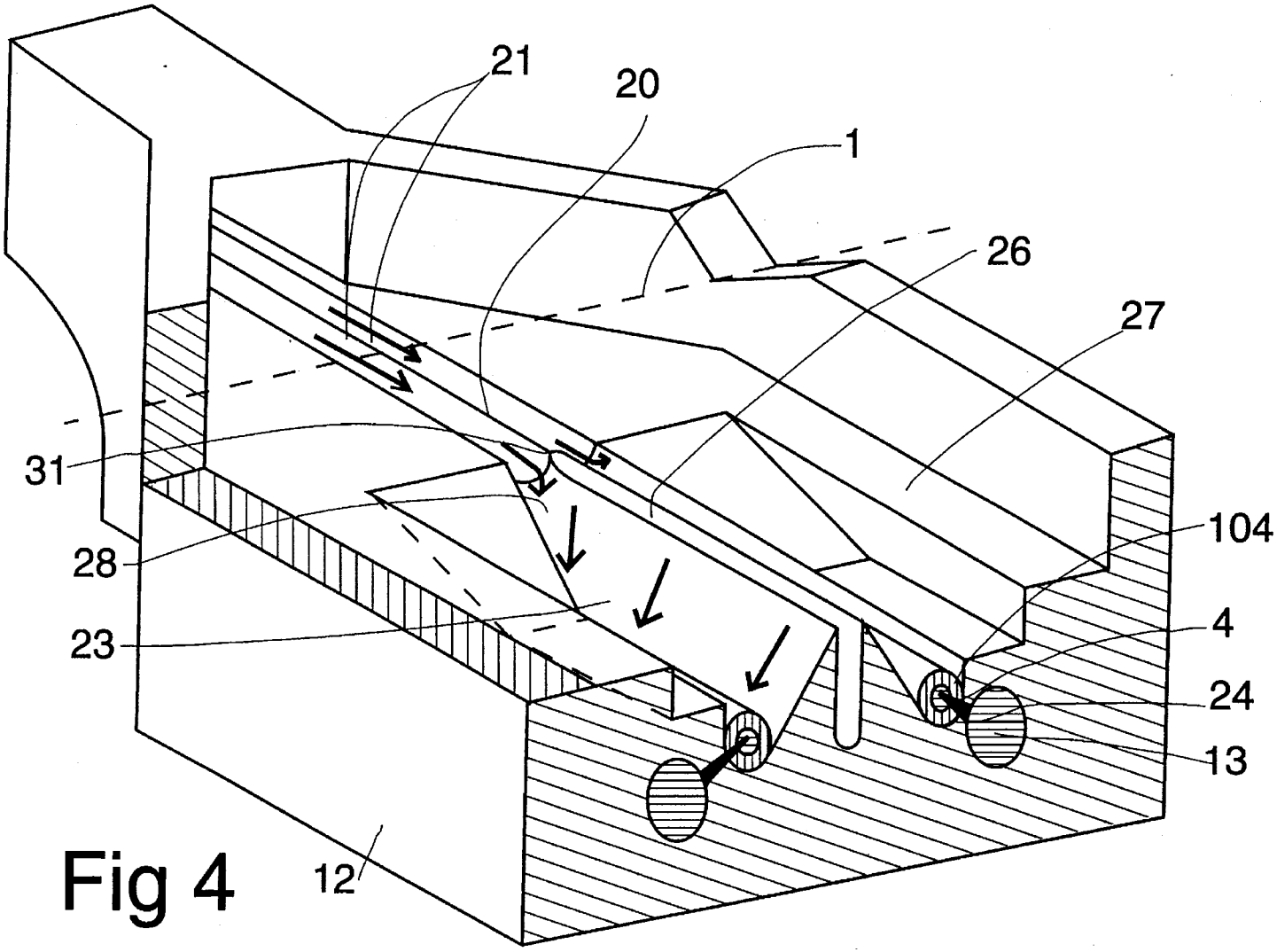
FIG. 4 is a perspective view through the plug, with the hinge axis perpendicular to the longitudinal axis of the cord, without the pressing block, the back portion and the back hood.
Figure 5:
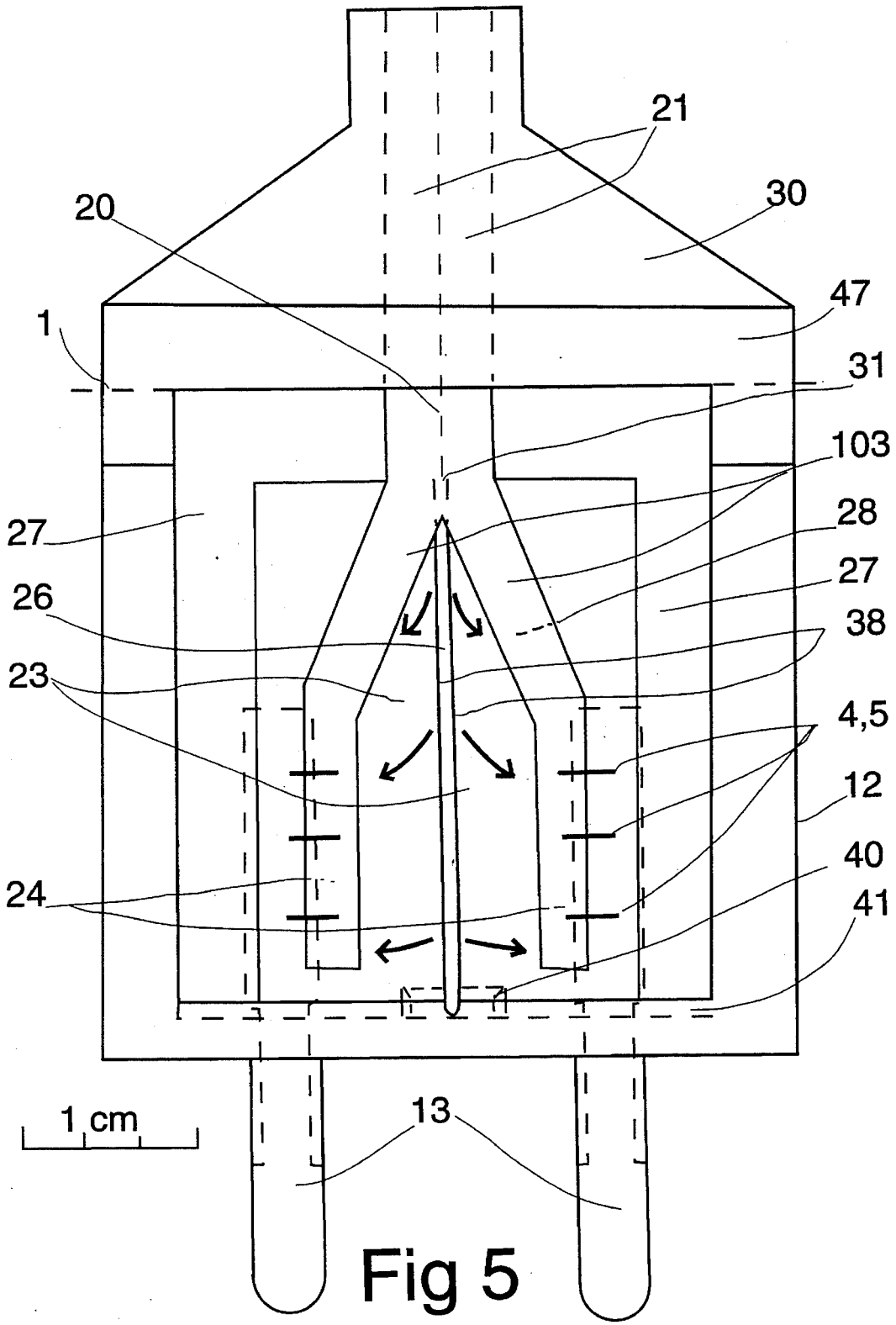
FIG. 5 is a down view through the plug, without the pressing block.

FIG. 4 represents the passive portion of the plug, and the arrows shows what happens. The cable is inserted in the plug from behind, placed in the leading grooves (21), and set into place on the wedging edge (20), all the way to the other end of the plug, where it is inserted in the stabilizing tip (40) (see FIGS. 5 and 7), not shown on FIG. 4. The cable is then cut by the blade (22) (see FIG. 7), split into two wires, that slide along sliding planes (23), down to the bottom of the contact site (24) (see FIG. 5), where they are led by each lower edge (25) of the scraper (35) (see FIGS. 6 and 7) and caught on the contact needles or spikes (4 or 5), which are built-in features of the plug male or female pins (13). The hinge (1) is represented by a doted line (FIG. 4). The receiving slot for the blade (26), and the closing device (27) are also shown. The descending part (28) of the leading grooves goes off the central longitudinal axis, to reach the contact site (24) (see FIG. 5 also). It is also worth mentioning the presence of the back hood (30), not shown on FIG. 4. FIG. 5 shows all the elements presented in FIG. 4, from an elevated point of view, which is more representative of the actual plug dimensions.

Figure 6:
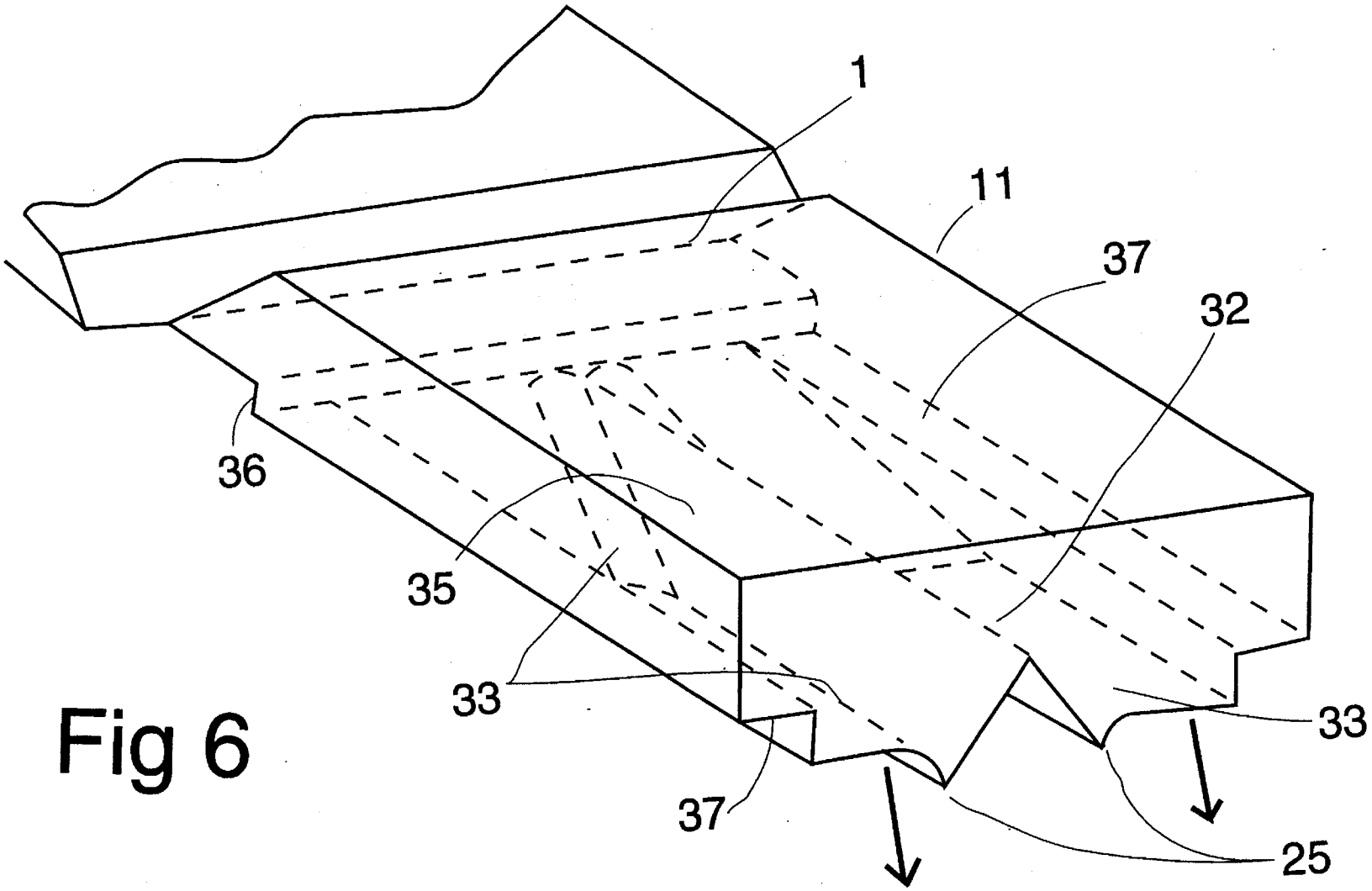
FIG. 6 is a down view through the pressing block, without the knife blade.

FIG. 6 shows the hinge (1), the scraper (35), the top portion of the leading grooves and the lower edges (25) of the scraper (that can also be considered as the starting point of the top portion (33) of the grooves). The flat part coming into contact with the closing device is called the closing hammer (37). Near the hinge, the front hood (34) lower surface is heightened by a raising portion (36), used to give way to the cable (not shown here). The blade is not shown either, but can be seen on FIG. 9 (*a,b*).

Figure 7:
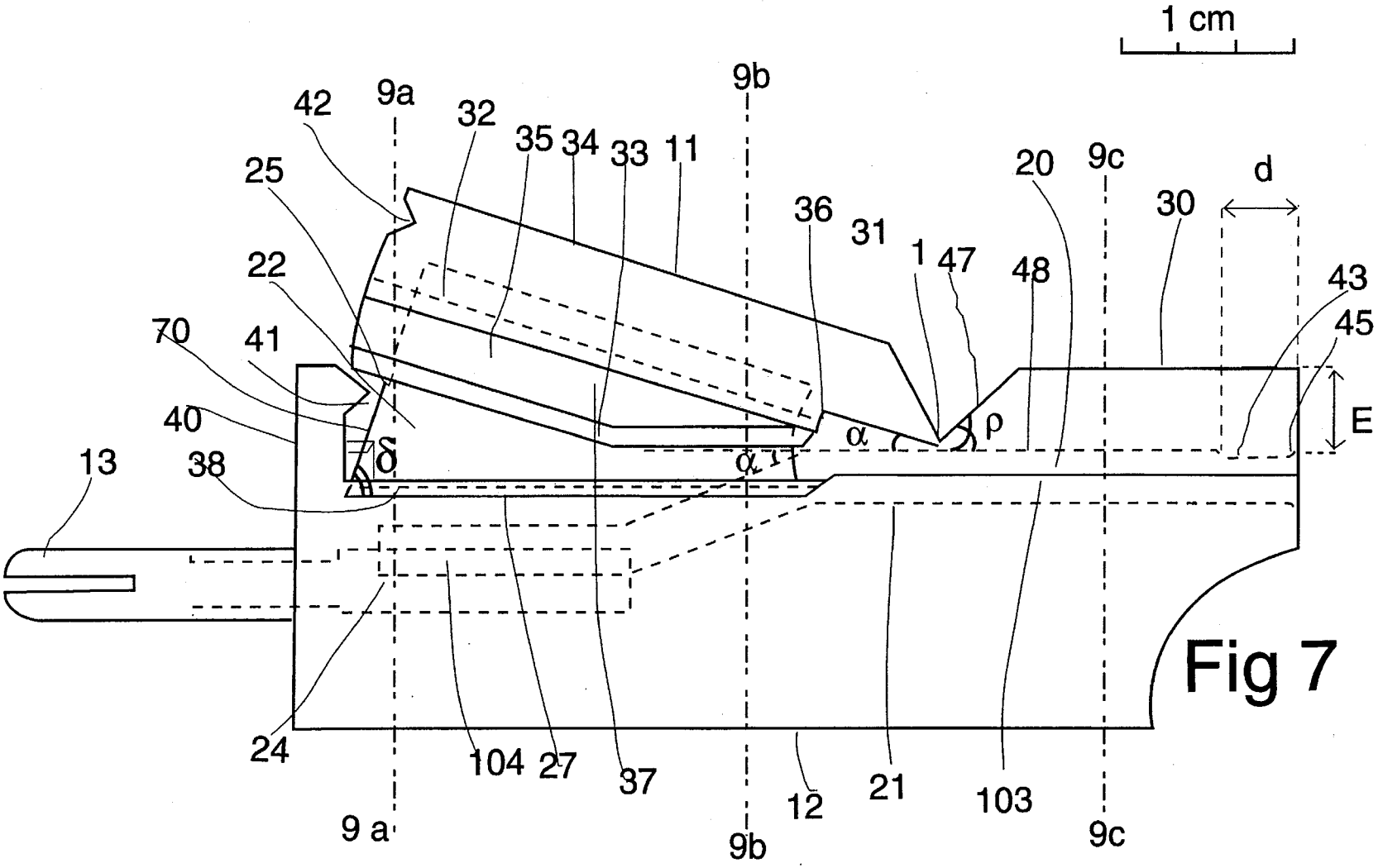
FIG. 7 is a side view through a female plug, with the pressing block open at an angle equal to that of the slope of the leading grooves.

FIG. 7 is a side view and also a complete view through the device. The cable (103) follows a two-turn path, which split it into two wires. We can also see the hinge (1) and the closing portion (27), as well as the closing hammer (37), that come in contact one with another in the closed position (see FIG. 9 *a,b* also). It is also worth mentioning the opening spot in the receiving slot (31) for the blade (see FIGS. 4 and 5 also). Only one higher edge (38) of this slot is represented here. The higher edge (32) of the scraper (35) is represented as a dotted line. The position of the pressing block is such that one can see that the wire (103)-containing cable has been cut prior to its being brought down by the top portion (33) of the leading grooves and by the scraper's edge (38). These two parts are still in a horizontal position and above the cord as the blade (22) is already under the edge (38) of the receiving slot, that the cord cannot access. The angle of the hood (34), hence the pressing block itself, is equal to α, which is the vertical angle at which the cord goes down to the contact site.

The back insertion of the cable can be seen (43) (see also FIG. 9*c*). This insertion hole is slightly smaller than the thickness of the smallest cable that can fit the plug, so that the cable has to be "forced into" on a small distance "d" but is free thereafter. The wedging edge (20) is rounded in (44), as well as the back hood (30) in (45) and the leading grooves (21) in (46). The hidden parts of the blade (22) are drawn in a dotted fashion. The cutting edge and the vertical part of the blade form an angle δ equal to (90°−α), in the front end. In the back end, the blade is shaped into a circular arc, with r=E/sin(ρ) (where E is the thickness of the back hood (30) and ρ, the angle between the wall (47) of the hinge (1) and the inner surface (48) of the back hood (30)). The radius r should be increased by one or two millimeters as in FIG. 7. The height of the blade (22) is equal to:

$$h=l_1\times tg(\alpha)+D/\sin(\delta)+AD+E/2$$

Figure 8:
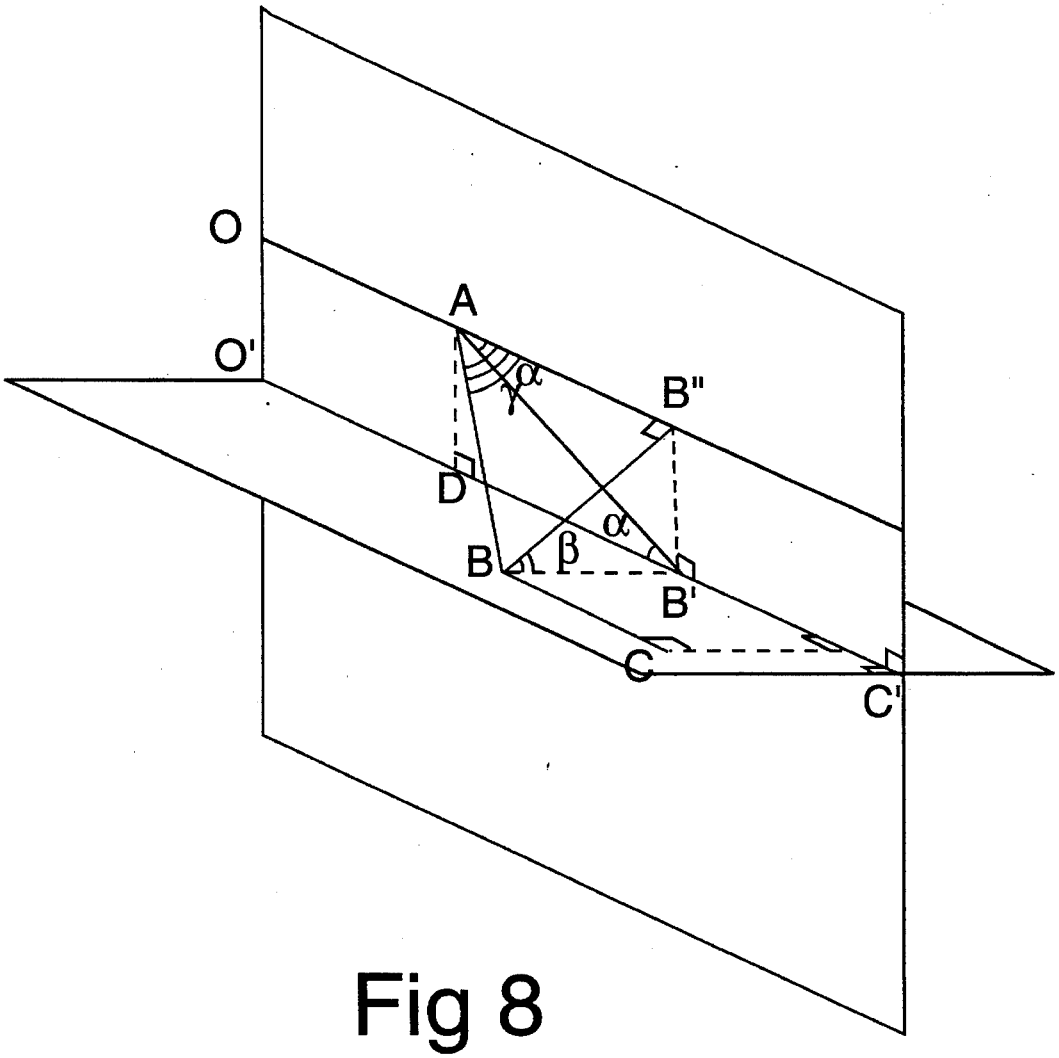
FIG. 8 is a perspective scheme showing the relationships between the angles and the dimensions of the various elements in the plug, for the first example with perpendicular axes.

(see p.3, lines 15–20). Finally, in order to know the length of the cutting edge, we must look at FIG. 8, which explains the relationships between the different angles and distances.

AD=B"B' and B'B=B"B'/tg(β) therefore B'B=AD/tg(β)

Moreover: B"B'=B'B/cos(β)

And: AB"=B"B'/tg(α) therefore AB"=AD/tg(α)

B"B/AB"=tg(γ) gives us γ and AB, since AB"/cos(γ)=AB

Furthermore: AB+BC=1 and OA+AB"+B'C'=L and

B'C'=AB+BC−AB"

If we assume that OABC is a broken line going through the center of a wire, we can notice that (AB+BC =1) is the length of the wire to be cut, and therefore, the minimum length of the blade cutting edge.

About the other dimensions of the plug:

If β is chosen so that the wire can slide easily on the sliding plane (23), that is, β≧40°, and BB' is determined by the standard spacing of the pins in an electric plug, AD is easily obtained, and hence the slope followed by the wire. Finally, BC should be long enough to accommodate at least three contact spikes with a 5 mm spacing lengthwise—i.e. BC≧10 mm—and OA should be chosen according to the total length of the plug. AB" is then easily calculated, as well as α, γ, finally AB, which allows for the calculation of the length of the cutting edge of the blade. The plug can then be built up.

Figure 9:
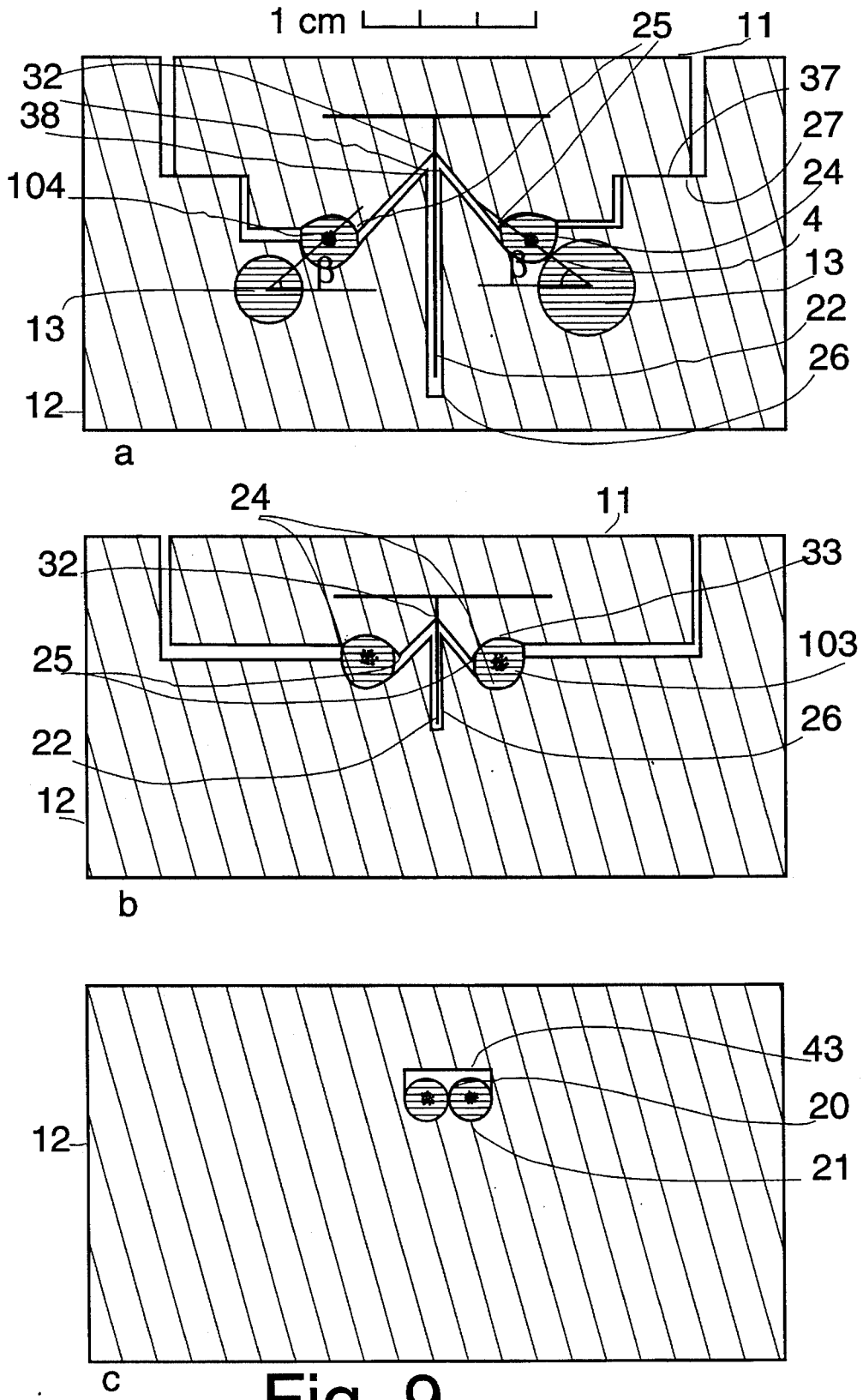
FIG. 9 shows three successive sectional views, 9*a*, 9*b*, 9*c*, of the plug shown FIG. 7 but, as if the pressing block was shut.

Successive sectional views of the plug will help in getting more specific details (FIG. 9).

FIG. 9(*a*) represents a male pin, and a female pin is shown on the left (13). If we want to use the same value for β in both cases, we need to vary the distance between the contact sites (24) and the pins (13). The male pin will then sit further away from the contact site than the female pin, and the difference will amount to the difference between the radii of the female and male pins. Drawings (*a*) and (*b*) show that the leading grooves (33) have a profile that slightly squeezes the wire (103). The T-shaped profile of the blade (22) facilitates its anchorage in the plastic material. The higher edge (32) of the scraper and the edges (25) of the scraper, used to drive the wires (103) to their contact site (24), are particularly worth-mentioning here. The two other drawings do not need any comment.

Figure 10:
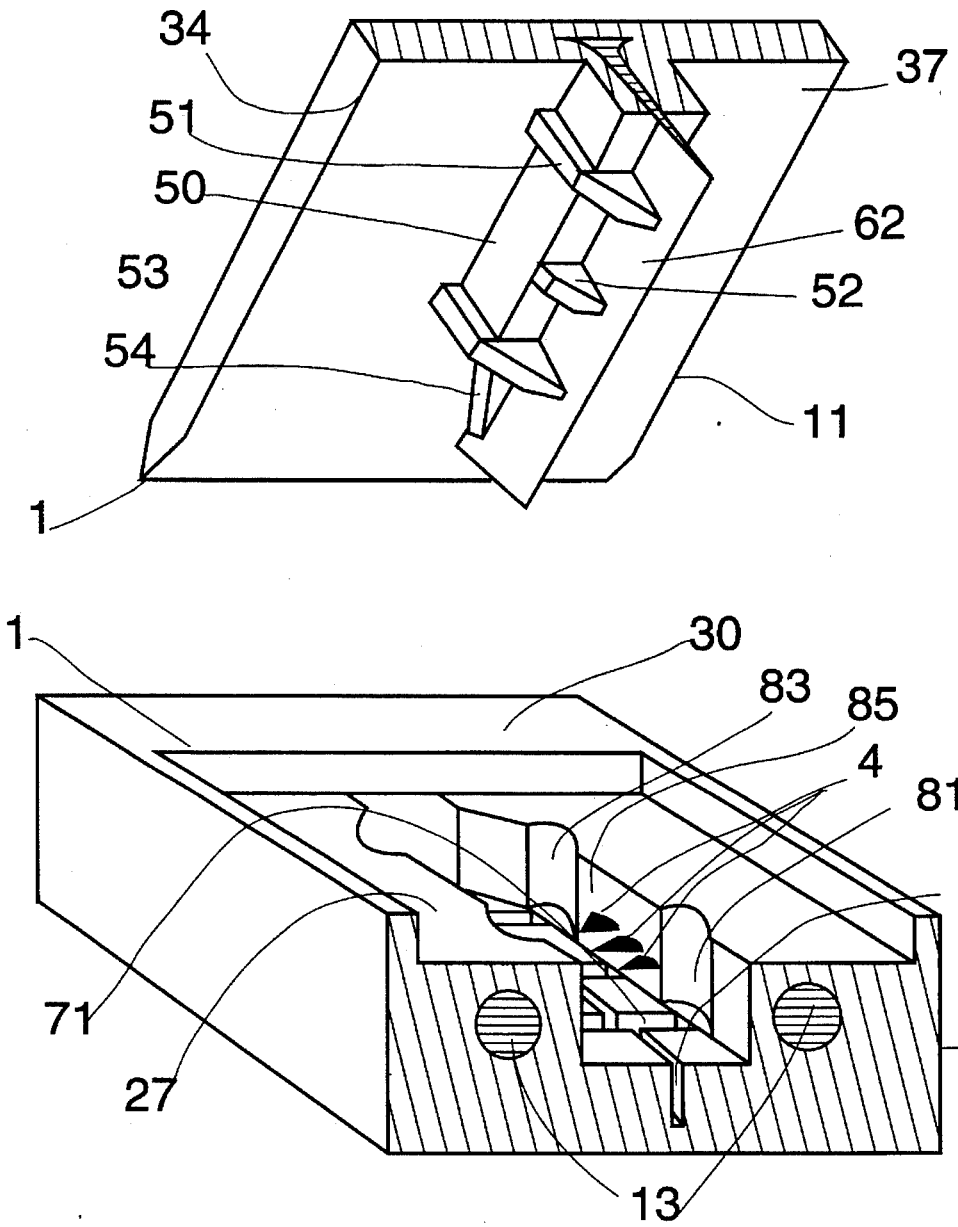
FIG. 10 is a perspective view, with the active portion being removed, and truncated on front, for an example of the plug according to the third version of the invention.

Let us now turn to FIG. 10, and describe the constituting elements of the plug, for the third embodiment of the invention:

Hinge (1), back portion of the hood (30), closing hammer (37), front portion of the hood (34), knife blade (62), male or female pins (13), filler bar (50), splitting corners or portions (front (51), central (52) and back (53)), cone-shaped back portion (54) of the filler bar, receiving slots for the splitting parts (front slot (71), central slot (72) and back slot (73)), side grooves (front (81) and back (83)), front and back slots, receiving slot for the blade (26), closing portion (27).

Figure 11:
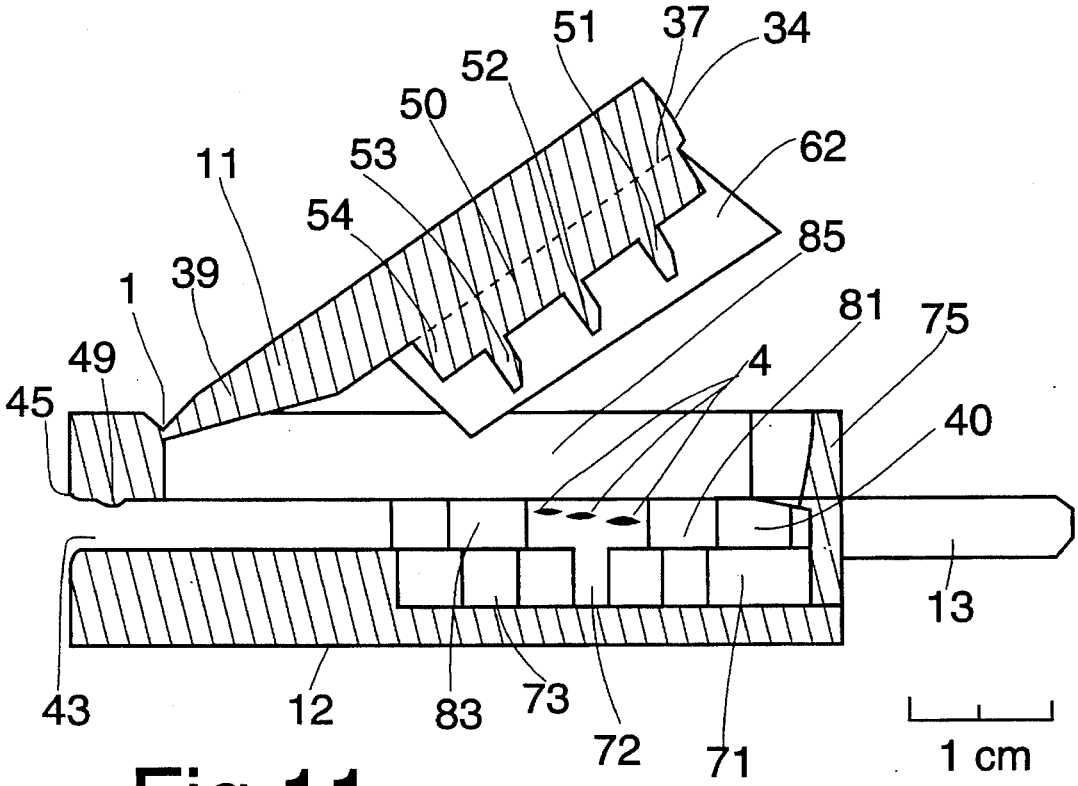
FIG. 11 is a longitudinal sectional and central view of the same example.

FIG. 11 shows the contact spikes (5), as well as the back insertion hole (43) for the cord. The hole outline (45) is round and includes a pinching device for the cord, a bump (49) here.

Figure 12:
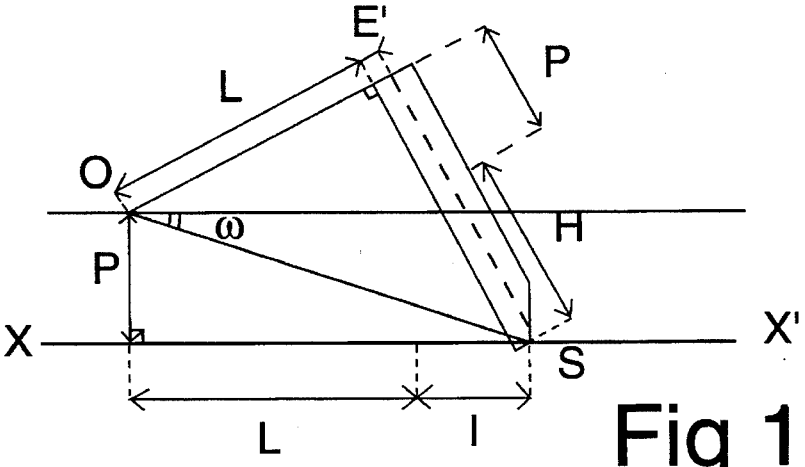
FIG. 12 is a scheme explaining how to calculate the minimum width of the grooves for the splitting portions.

The front portion of the blade (62) is longer than the hood (34), in order to fully cut the cord in its front end, but this is not necessary. When set into place, the cord meets the stabilizing tip (40), the outline of which is reamed and rounded so that the cord can be smoothly inserted. The hood is rather thick, therefore its back portion (39) can be tapered, to get a thinner part, before the actual thinning down that allows for the hinge (1). FIG. 12 shows the relationships between the different dimensions of the plug: one notices the contact spikes (5), which are arranged halfway through the cord thickness; the splitting portions (51,52,53) and their respective sites (71,72,73); the side grooves (81,83) corresponding to the extreme sites (71,73) and, of course, it should be noted that the depth of a receiver for a splitting portion cannot be smaller than H, which is the excess height of the filler bar (50) lower level.

Let us assume a splitting portion of thickness E, located at a distance L from an axis O (representing the hinge (1)). The axis O is situated at a distance P from a plane X–X' and has to penetrate this plane by a depth H. The width of the receiver for the splitting portion must be at least equal to P/tg(ω)−L, where ω is the angle (XX')SO, where S is the furthest extremity from the axis O, and the SO line, the distance between the base of the splitting portion and the axis. The angle ω is then calculated as follows:

$$P/SO=P/[(P+H)^2+(E'+L)^2]^{1/2}=\sin(\omega).$$

The values for L, H, and P depend on the dimensions of the plug. The thickness E' should be as small as possible, but big enough for the splitting portion to remain rigid during the plug closing operation. For clarity in the drawings, E has been overestimated, and the other dimensions do not respect the actual proportions.

Figure 13:
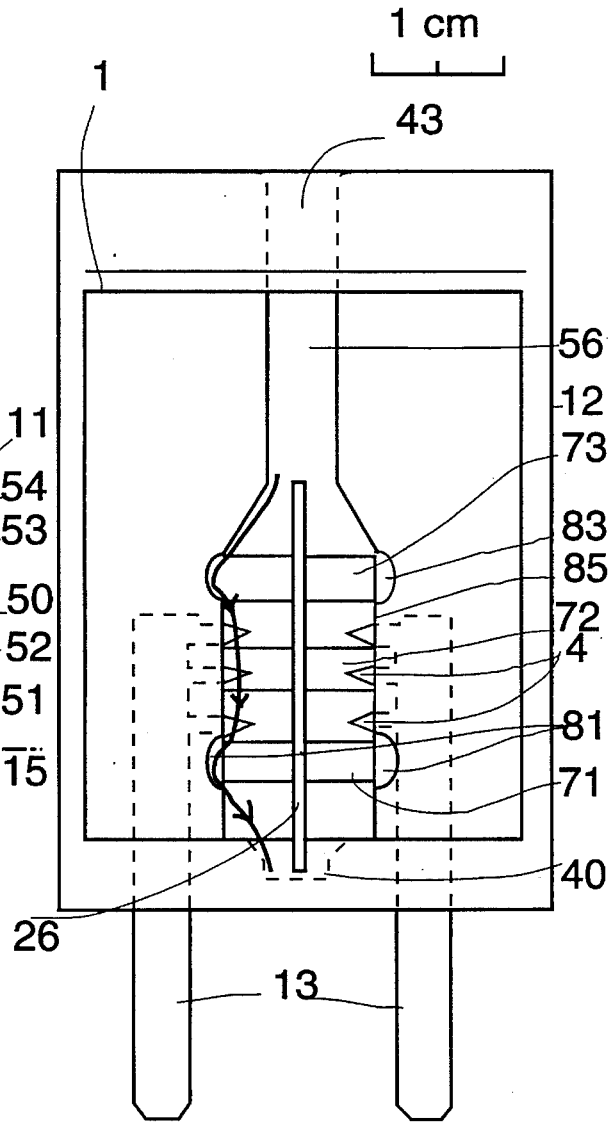
FIG. 13 is an elevated view of the inner surface of the lower portion of the example according to the third embodiment.

FIG. 13 displays the receiving slot of the blade (26), and partly showing through, the pins (13) comprising the contact spikes (4). The channel (56), that drives the cable to the stabilizing tip (40), starts right after the insertion hole (43). The specific width of this channel is the average of all conventional cable diameters, so that the thinnest cable will be slightly loose and the thickest will be slightly squeezed, but without any damage, due to the elasticity of the sheathe. Once the plug is shut, the cable follows the path marked with arrows, winding through the side grooves (81,82), and constantly remaining under the pressure of the splitting portions, acting as tighteners.

Figure 14:
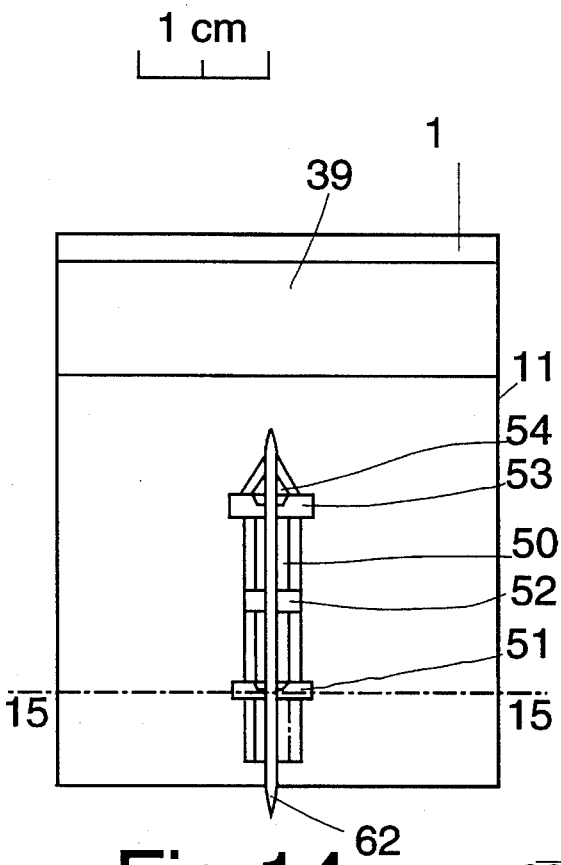
FIG. 14 is an elevated view of the inner surface of the upside-down higher portion of the same example (third embodiment).
Figure 15:
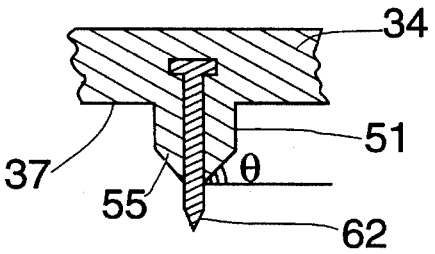
FIG. 15 is a sectional view of the previous example (FIG. 14).

FIG. 14 shows the triangular back part of the filler bar (50), whose lower edges are chamfered, and the blade (62) whose back and front ends are slightly longer than the bar. This feature allows for the complete cutting of the cable in front, and for the a cut remote enough from the back end of the bar, so that the latter can easily penetrate as the plug gets shut. FIG. 15 is a front view of a front splitting portion (51). The more pointed its projection cone (55) is, the easier the closing of the plug. However, the height, H, is limited by that of the plug case. It requires θ≧45°. The section of the splitting portion should also be rounded. The splitting portions also act as blade tighteners.

The last embodiment of the invention is considered the best. The novel feature is the filling of the inter-wire space during the splitting by a volume that belongs to the blade-containing part (the active plug portion here). Such volumes or projections have not been described in the three embodiments of the invention—and will not be—as they do not modify any fundamental aspect of the invention. However a flat part must be designed on the outer surface of the passive plug portion, so that the plug remains stable as the final closing of the system is performed.

FIG. 16*a*, 16*b*, 17, 18 relate to the contact needles or spikes for the last two versions of the invention. These have the same characteristics as for the first version and the figures only describe their arrangement. FIG. 16*a* is a side view and FIG. 16*b* is a front view of the arrangement for a male plug (the angle β only relates to the second version).

FIG. 17 is a front view of the penetration of the cable through its sheath (101) and its heart (102). The spike (4 or 5) length is greater than for the other example of the invention, because the space between the cable (104) and the pin (13) must be taken into account. It is similar for the third example.

FIG. 18 shows the shape of the contact spikes, the point (60) and edges (61) of which must be sharp to ensure a thorough penetration.

In order to have suitable hinges, the three embodiments of the invention require at least three metallic pieces partly embedded into an insulating plastic material, such as polypropylene. The moulding of the plastic pieces is a one-step operation.

I claim:

1. Flat cable two-pin electric plug composed of two parts,one passive (12), the other active (11) connected by a hinge (1), said plug having needles (5) or contact spikes (4) designated to cross the conductive heart (102) of each wire (104) of the cable (103), comprising a cutting blade (2,22 or 62) which cutting edge is parallel to the longitudinal axis of the cable when positioned, said cutting blade being embedded in one of the said parts of the plug and mainly acts as a separator of the two wires (104) of the cable (103) at least ten millimeters lengthwise.

2. An electric plug as described in the claim 1, with the rotating axis of the hinge (1) joining the active (11) and the passive portion (12) paralell to the longitudinal axis of the cable (103), comprising male pins (13) diametrally split along the longitudinal median plane which contains a diameter of each of the pins (13), each of the two halves of each pin comprising a hollow half cylindrical aera embedded in the active portion (11) corresponding to one of the said halves of the siad pin (13), or embedded in the passive portion (12) for the other of the said halves of the said male pin (13), the said hollow aera (7) being used as a contact cavity for each wire of the cable, the said hollow aera (7) also including laterally a female pin (8) for one of the halves (11 or 12) of the plug or a male pin (9) for the other half, said pins (8 and 9) designated to fit into each other, to act both as contact between the two halves of the pins (13) and as a pressure locking of the system.

3. Electric plug as described in the claim 1, with the rotating axis of the hinge (1) joining the passive half (12) and the active one (11) of the plug, parallel to the longitudinal axis of the cable (103) comprising female pin (7) diametrally split along the longitudinal median plane which contains a diameter of each of the said pins (7), each of the halves of the females pins (7) including laterally an aera (16) with rear female parts (8) on one of the halves (11 or 12) of the plug and rear male parts (9) on the other half of the plug designated to fit into each other, to both act as good contact between the two halves of the pins (7) and as a pressure locking of the system.

4. Electric plug as described in the claim 1 with the axis of the hinge perpendicular to the longitudinal axis of the placed cable (103), comprising in its active part (11), also called the pressing block, beside the blade (22) a two slopes roof-shaped scraper (35) with lower edges (25) fixing the limits of the leading grooves designated to drive and to maintain the wires (104) of the cable (103), after the cutting of the said cable in contact with the passive half (12) or more precisely in their contact site (24), after having made them slide over the sliding planes (23) on which fits the scraper (35), the said passive half (12) also comprises a wedging edge (20) and a stabilizing tip (40) for the cable (103) where the said cable lays before the cutting operation.

5. An electrical plug as described in claim 1, with the axis of its hinge (1) perpendicular to the longitudinal axis of the placed cable, comprising on the inner surface of the active part (11), beside the blade (62), a filler bar (50) which rear part is triangular shaped, at least three splitting portions (51,52,53) which profile is cone shaped, ending splitting portions (51,53) whose maximum width is grater than that of the filler bar (50), also acts as a locking device of the wires (104) that wind through side grooves (81,83) corresponding to the splitting portions (51,53), a front and rear endings of the blade (62) protruding the front and rear endings of the filler bar (50); the inner surface of the passive part (12) comprising a base (80) parallel to the longitudinal median plane, the wires (104) of the cable (103) sliding on the said base (80) during the shutting down of the plug, the said wires (104) getting pierced by the contact spikes (4) arranged laterally,the said inner surface comprising also projections called receiving slots (71,72,73) for the splitting portions (51,52,53 respectively), a channel (56) and a stabilizing tip (40) into whose the cable (103) is set before the cutting operation.

* * * * *